US011508497B2

(12) United States Patent
Shimizu

(10) Patent No.: US 11,508,497 B2
(45) Date of Patent: Nov. 22, 2022

(54) COMMUNICATION CABLE AND WIRE HARNESS

(71) Applicant: YAZAKI CORPORATION, Tokyo (JP)

(72) Inventor: Toshiharu Shimizu, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/079,392

(22) Filed: Oct. 23, 2020

(65) Prior Publication Data

US 2021/0125747 A1 Apr. 29, 2021

(30) Foreign Application Priority Data

Oct. 25, 2019 (JP) ..... JP2019-194066

(51) Int. Cl.
*H01B 11/02* (2006.01)
*H01B 3/30* (2006.01)
*H01B 13/012* (2006.01)

(52) U.S. Cl.
CPC ..... *H01B 11/02* (2013.01); *H01B 3/308* (2013.01); *H01B 13/0129* (2013.01)

(58) Field of Classification Search
CPC .. H01B 11/203; H01B 7/0861; H01B 7/0823; H01B 7/0838; H01B 11/002; H01B 11/1895; H01B 11/1891; H01B 11/04; H01B 11/1091; H01B 9/02; H01B 11/00; H01B 11/10; H01B 7/0876; H01B 7/0807; H01B 11/005; H01B 7/0892; H01B 7/188; H01B 11/08; H01B 11/1066; H01B 13/14; H01B 7/02; H01B 11/20; H01B 7/0208; H01B 7/1875; H01B 7/0869; H01B 11/1869; H01B 11/183; H01B 11/1025; H01B 3/441; H01B 11/1008; H01B 7/0045; H01B 7/0216; H01B 11/1058; H01B 11/12; H01B 11/18; H01B 13/222; H01B 3/307; H01B 7/17; H01B 11/02; H01B 11/1016; H01B 11/1813; H01B 11/1826;
(Continued)

(56) References Cited

U.S. PATENT DOCUMENTS 1,904,547 A * 4/1933 Schumann ..... H01B 11/00 174/27
4,045,607 A * 8/1977 Swearingen ..... H01B 3/44 428/209

(Continued)

FOREIGN PATENT DOCUMENTS

CN 203150304 U 8/2013
JP 2015-185527 A 10/2015

*Primary Examiner* — Krystal Robinson
(74) *Attorney, Agent, or Firm* — Kenealy Vaidya LLP

(57) ABSTRACT

A communication cable includes two-core communication wires, a drain wire, and a metal foil collectively covering the two-core communication wires and the drain wire. The two-core communication wires are twisted, and the metal foil is wound around the two-core communication wires with an adhesion strength of 1.21 MPa or more. Preferably, the two-core communication wires are twisted with a twist pitch of 20 mm or more and 60 mm or less. The communication cable further may include a restraint formed of a resin coating extruded around the metal foil or a resin film laterally wound around the metal foil.

7 Claims, 7 Drawing Sheets

| | COMPARATIVE EXAMPLE 1 STP WIRE | COMPARATIVE EXAMPLE 2 STP WIRE | COMPARATIVE EXAMPLE 3 STP WIRE | EXAMPLE 1 15mm | EXAMPLE 2 20mm | EXAMPLE 3 40mm | EXAMPLE 4 60mm | EXAMPLE 5 80mm | EXAMPLE 6 100mm | COMPARATIVE EXAMPLE 4 SPP WIRE |
|---|---|---|---|---|---|---|---|---|---|---|
| MAXIMUM VALUE | 0.26 | 0.16 | 0.16 | 1.48 | 1.61 | 1.74 | 2.02 | 2.29 | 2.36 | 2.90 |
| AVERAGE VALUE | 0.23 | 0.13 | 0.13 | 1.35 | 1.48 | 1.66 | 1.81 | 2.08 | 2.14 | 2.80 |
| MINIMUM VALUE | 0.20 | 0.11 | 0.08 | 1.21 | 1.25 | 1.60 | 1.63 | 1.88 | 1.97 | 2.71 |

(58) Field of Classification Search
CPC ..... H01B 11/1856; H01B 13/0129; H01B 13/016; H01B 13/2626; H01B 1/02; H01B 1/023; H01B 1/026; H01B 3/10; H01B 3/30; H01B 3/305; H01B 3/306; H01B 3/308; H01B 3/40; H01B 3/442; H01B 3/445; H01B 7/009; H01B 7/025; H01B 7/18; H01B 7/1865; H01B 7/1895; H01B 7/226; H01B 7/2825; H01B 7/295; H01B 7/30; H01B 7/225; H01B 12/06; H01R 12/53; H01R 13/6592; C23C 18/31
See application file for complete search history.

(56) References Cited

U.S. PATENT DOCUMENTS 5,084,219 A * 1/1992 Sigur ..... B29C 70/44 156/173
5,183,973 A * 2/1993 Ingle ..... H05K 1/09 174/254
5,216,204 A * 6/1993 Dudek ..... H01B 11/1025 174/102 SC
5,327,513 A * 7/1994 Nguyen ..... G02B 6/4403 174/117 A
6,248,954 B1 * 6/2001 Clark ..... H01B 11/04 174/113 R
6,255,594 B1 * 7/2001 Hudson ..... H01B 7/295 174/121 A
6,403,887 B1 6/2002 Kebabjian et al.
6,410,137 B1 * 6/2002 Bunyan ..... H05K 9/0084 428/407
6,448,500 B1 * 9/2002 Hosaka ..... H01B 11/08 174/113 R
6,815,611 B1 * 11/2004 Gareis ..... H01B 11/1025 174/36
8,759,681 B2 * 6/2014 Doi ..... B60R 16/0215 174/117 A
2003/0035948 A1 * 2/2003 Fujimaru ..... B32B 27/10 428/354
2003/0070831 A1 * 4/2003 Hudson ..... H01B 7/295 174/113 R
2010/0258344 A1 * 10/2010 Creasy, Jr. ..... C08K 5/49 524/590
2011/0155458 A1 * 6/2011 Kato ..... C07C 227/04 174/74 R
2011/0247856 A1 * 10/2011 Matsuda ..... H01B 11/203 174/108
2011/0315419 A1 12/2011 Grant et al.
2012/0024566 A1 * 2/2012 Shimosawa ..... H01B 11/1091 174/107
2012/0048598 A1 * 3/2012 Kaimori ..... H05K 3/386 524/80
2012/0261158 A1 * 10/2012 Daniel ..... H01B 3/427 174/102 R
2014/0182881 A1 * 7/2014 Huang ..... H01B 11/1091 174/103
2016/0174422 A1 * 6/2016 Kobayashi ..... H01B 11/002 174/107
2016/0207287 A1 * 7/2016 Kim ..... B32B 27/281
2016/0336094 A1 * 11/2016 Omura ..... H01B 7/2825
2016/0351300 A1 * 12/2016 Daniel ..... H01B 7/18
2017/0231124 A1 * 8/2017 Kobayashi ..... H05K 9/0098
2018/0114610 A1 * 4/2018 Uegaki ..... H01B 7/18

* cited by examiner

| | COMPARATIVE EXAMPLE 1 STP WIRE | COMPARATIVE EXAMPLE 2 STP WIRE | COMPARATIVE EXAMPLE 3 STP WIRE | EXAMPLE 1 15mm | EXAMPLE 2 20mm | EXAMPLE 3 40mm | EXAMPLE 4 60mm | EXAMPLE 5 80mm | EXAMPLE 6 100mm | COMPARATIVE EXAMPLE 4 SPP WIRE |
|---|---|---|---|---|---|---|---|---|---|---|
| MAXIMUM VALUE | 0.26 | 0.16 | 0.16 | 1.48 | 1.61 | 1.74 | 2.02 | 2.29 | 2.36 | 2.90 |
| AVERAGE VALUE | 0.23 | 0.13 | 0.13 | 1.35 | 1.48 | 1.66 | 1.81 | 2.08 | 2.14 | 2.80 |
| MINIMUM VALUE | 0.20 | 0.11 | 0.08 | 1.21 | 1.25 | 1.60 | 1.63 | 1.88 | 1.97 | 2.71 |

COMMUNICATION CABLE AND WIRE HARNESS

CROSS-REFERENCE TO RELATED APPLICATIONS

This application is based on and claims priority under 35 USC 119 from Japanese Patent Application No. 2019-194066 filed on Oct. 25, 2019, the contents of which are incorporated herein by reference.

TECHNICAL FIELD

The present invention relates to a communication cable and a wire harness.

BACKGROUND ART

In the related art, in a communication wire for an automobile, for the convenience of a layout of a wire harness, a large number of bent portions of an electric wire are generated in space-saving, and therefore a shielded twisted pair (STP) wire in which the electric wires are twisted to have flexibility has been used. In such an STP wire, for example, a metal foil is provided around the twisted wire, but a distance between a conductor of the twisted wire and the metal foil is likely to be uneven, so that a large increase in an attenuation amount (suck-out) at a specific frequency is generated.

Therefore, in the consumer field, a shielded parallel pair (SPP) wire has been used in which a drain wire is arranged in a gap between two-core communication wires arranged in parallel, and these wires are collectively covered with a metal foil (see, for example, Patent Literature 1). In the SPP wire, the two-core communication wires are not twisted, a distance between a conductor of the communication wire and the metal foil is likely to be stable, and suck-out can be suppressed.

CITATION LIST

Patent Literature

Patent Literature 1: JP-A-2015-185527

However, for a consumer SPP wire described in Patent Literature 1, since the two-core communication wires are not twisted, there is a direction in which bending is easy and a direction in which the bending is difficult, and there is room for improvement in terms of flexibility. Therefore, when two wire cores are twisted, the distance between the conductor of the twisted wire and the metal foil is likely to be uneven, which causes a problem of suck out.

SUMMARY OF INVENTION

According to an embodiment, a communication cable and a wire harness can improve flexibility while suppressing suck-out.

According to the present invention, there is provided a communication cable including: two-core communication wires; a drain wire; and a metal foil collectively covering the two-core communication wires and the drain wire. The two-core communication wires are twisted, and the metal foil is wound around the two-core communication wires with an adhesion strength of 1.21 MPa or more.

According to the present invention, since the two-core communication wires are twisted, it is not difficult to bend the wire in a specific direction, and flexibility can be improved as compared with the SPP wire. In addition, since the metal foil is wound around the two-core communication wires with the adhesion strength of 1.21 MPa or more, the adhesion strength between the two-core communication wires and the metal foil is improved, so that suck-out is suppressed as compared with the STP wire. Therefore, it is possible to provide the communication cable and a wire harness capable of improving the flexibility while suppressing suck-out.

DESCRIPTION OF EMBODIMENTS

Hereinafter, the present invention will be described in accordance with a preferred embodiment. The present invention is not limited to the embodiment to be described below, and can be changed as appropriate without departing from the spirit of the present invention. In addition, although some configurations are not shown or described in the embodiment to be described below, it goes without saying that a known or well-known technique is applied as appropriate to details of an omitted technique within a range in which no contradiction occurs to contents to be described below.

Figure 1:
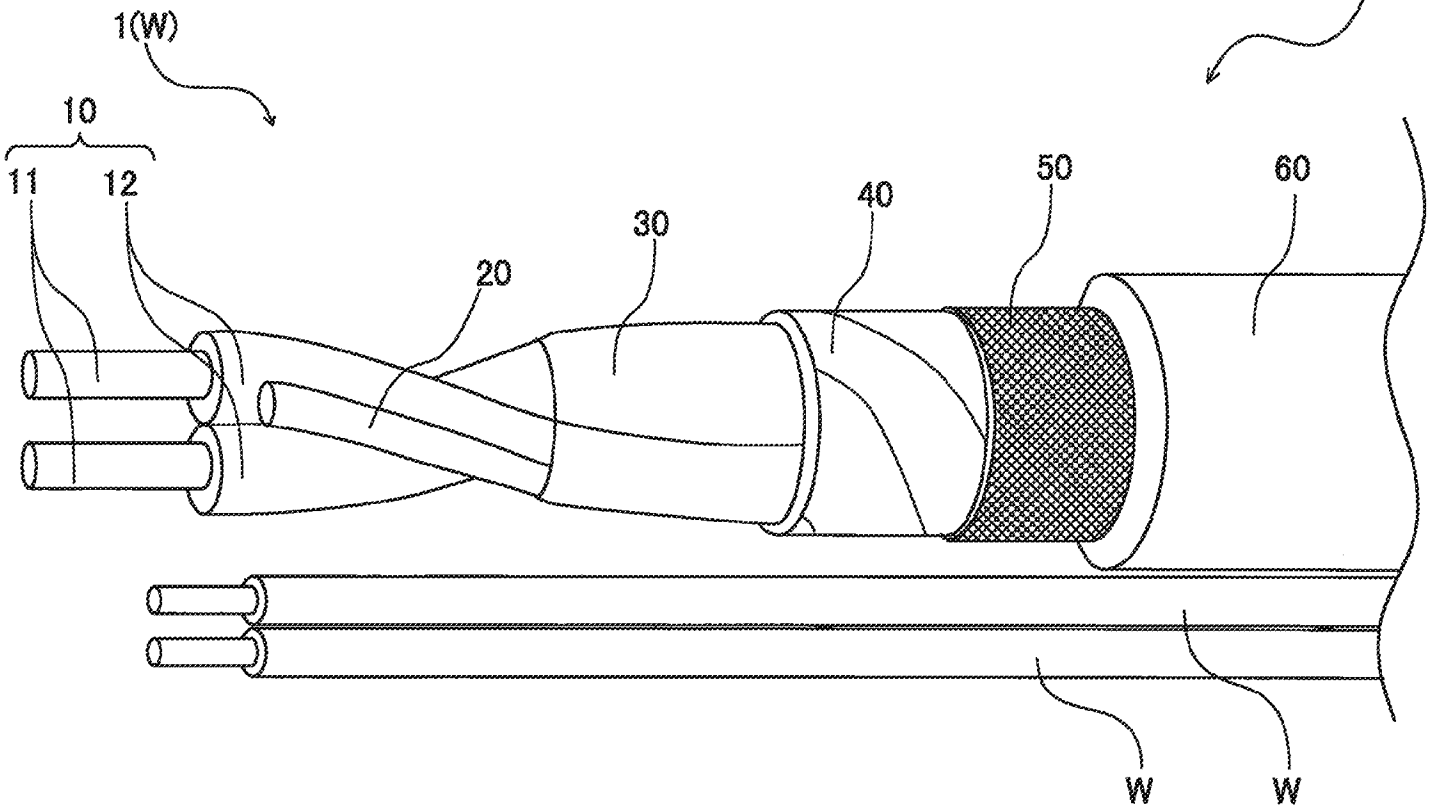
FIG. 1 is a perspective view showing an example of a wire harness including a communication cable according to an embodiment of the present invention.

FIG. 1 is a perspective view showing an example of a wire harness including a communication cable according to an embodiment of the present invention.

As shown in FIG. 1, a wire harness WH according to the present embodiment is formed by bundling a plurality of electric wires W, and at least one (one circuit) of the plurality of electric wires is configured by a communication cable 1 to be described in detail below.

Such a wire harness WH may be provided with connectors (not shown) at both end portions of the plurality of electric wires W, for example, or may be wrapped with a tape (not shown) in order to bundle the communication cable 1. In addition, the wire harness WH may include an exterior component (not shown) such as a corrugated tube.

The communication cable 1 includes two-core communication wires 10, a drain wire 20, a metal foil 30, and a restraint 40.

Each of the two-core communication wires 10 is an electric wire having a circular cross section for signal transmission. The two-core communication wires 10 each include a conductor 11 and an insulator 12. In the present embodiment, the two-core communication wires 10 are preferably twisted so that a twist pitch is 20 mm or more and 60 mm or less. The drain wire 20 is arranged at a position of a gap that is formed between the two-core communication wires 10, each having a circular cross section, when they are brought into contact with each other in a radial direction, and is, for example, a bare wire having no coating in the present embodiment. The drain wire 20 has a spiral shape in a longitudinal direction along the two-core communication wires 10 in a relation in which the two-core communication wires 10 are twisted.

Here, the conductor 11 and the drain wire 20 of the two-core communication wire are made of, for example, a soft copper wire, a copper alloy wire, a tin-plated annealed copper wire, a tin-plated copper alloy wire, a silver-plated annealed copper wire, a silver-plated copper alloy wire, or the like. In the present embodiment, the conductor 11 and the drain wire 20 are assumed to be twisted wires in which a plurality of element wires are twisted, but the present invention is not limited thereto, and the conductor 11 and the drain wire 20 may not be the twisted wires.

The insulator 12 is provided on an outer periphery of the conductor 11, and is made of, for example, polyethylene (PE), polypropylene (PP), polytetraluoroethylene (PTFE), foamed PE, PP, and PTFE, or the like.

The metal foil 30 is made of a metal such as aluminum or copper, and the metal foil collectively covers the two-core communication wires 10 and the drain wire 20 by vertically attaching them (or laterally winding). In addition, the metal foil 30 may be a resin tape to which a metal foil is adhered. The resin tape may be a metal foil in which aluminum or copper is vapor-deposited on a base material. Incidentally, in the present embodiment, a copper foil tape is used as the metal foil 30.

The restraint 40 is an insulator provided in contact with an outer peripheral side of the metal foil 30, and is made of a resin film such as polyethylene terephthalate (PET) or PTFE or a resin extrusion coating.

The communication cable 1 according to the present embodiment may include a braid 50 and a sheath 60. The braid 50 is, for example, a braided shield made of the same material as the metal foil 30. The sheath 60 is an insulator that collectively covers an internal configuration, and is made of a resin material such as polyvinyl chloride (PVC), PP, or PE.

Here, in the present embodiment, the metal foil 30 is provided on the two-core communication wires 10 with an adhesion strength of 1.21 MPa or more (a measurement result in a measurement method described later). Therefore, adhesion between the two-core communication wires 10 and the metal foil 30 is improved, and suck-out is suppressed.

The communication cable 1 according to the present embodiment is manufactured, for example, as follows. First, the two-core communication wire 10 and the drain wire 20 are arranged in parallel, the metal foil 30 is wound thereon, and the restraint 40 is provided. After that, the two-core communication wires 10 are twisted together with the metal foil 30 and the restraint 40 to have a predetermined twist pitch, and then the braid 50 and the sheath 60 are provided. As described above, the communication cable 1 is manufactured. It should be noted that the restraint 40 may be provided by the extrusion coating after the two-core communication wires 10 are twisted.

Figure 2:
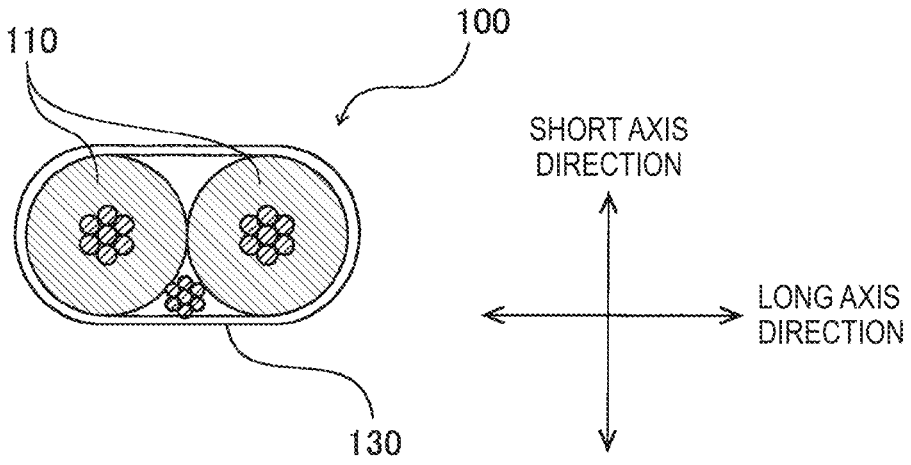
FIG. 2 is a sectional view of a communication cable according to a first comparative example.

Next, prior to describing an outline of an operation of the communication cable 1 according to the present embodiment, a communication cable according to a comparative example is shown. FIG. 2 is a sectional view of a communication cable according to a first comparative example, and FIG. 3 is a sectional view of a communication cable according to a second comparative example.

A communication cable 100 shown in FIG. 2 is a so-called SPP wire in which so-called two-core communication wires 110 are linearly arranged in parallel. In this SPP wire, a metal foil 130 tends to easily adhere to the two-core communication wires 110. However, the communication cable 100 according to the first comparative example is difficult to bend in a direction (long axis direction) in which the two-core communication wires 110 are aligned, and it is difficult to say that the communication cable 100 has excellent flexibility.

Figure 3:
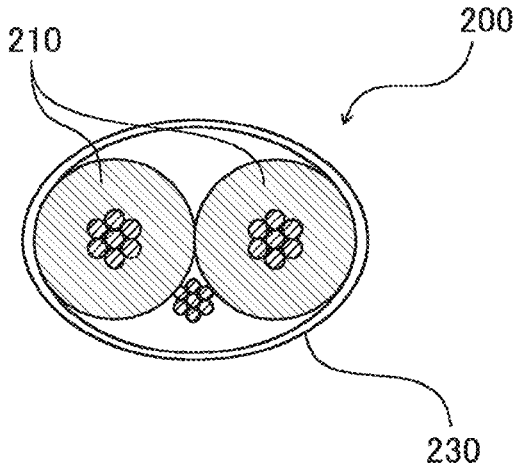
FIG. 3 is a sectional view of a communication cable according to a second comparative example.

A communication cable 200 shown in FIG. 3 is a so-called STP wire obtained by twisting so-called two-core communication wires 210. Since the two-core communication wires 210 are twisted in this STP wire, the STP wire does not have a structure that is difficult to bend in a specific direction as shown in FIG. 2, and tends to have excellent flexibility. However, in the communication cable 200 according to the second comparative example, since a metal foil 230 is wound on the two-core communication wires 210 after the two-core communication wires 210 are twisted, the metal foil 230 tends to be difficult to adhere to the two-core communication wires 210.

In a case where the metal foil 230 does not adhere to the two-core communication wire 210, a distance between a conductor 211 of the two-core communication wire 210 and the metal foil 230 is likely to be uneven, which causes a problem of suck-out.

Figure 4:
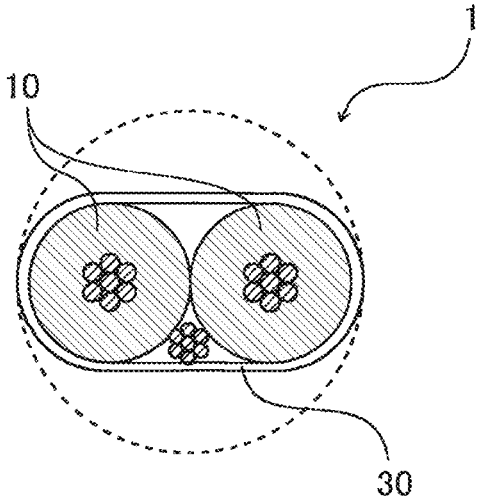
FIG. 4 is a sectional view of a main part of the communication cable according to the present embodiment.

FIG. 4 is a sectional view of a main part of the communication cable 1 according to the present embodiment. As shown in FIG. 4, in the communication cable 1 according to the present embodiment, the two-core communication wires 10 are twisted. Therefore, a structure of the communication cable 1 is not difficult bent in a specific direction, and flexibility thereof tends to be excellent. Further, in the present embodiment, since the metal foil 30 is provided on the two-core communication wire 10 with the adhesion strength of 1.21 MPa or more, the adhesion is improved, and suck-out can be suppressed.

Next, results of test or the like of the communication cables according to Examples and Comparative Examples will be described.

(Adhesion Strength Test)

Figure 5:
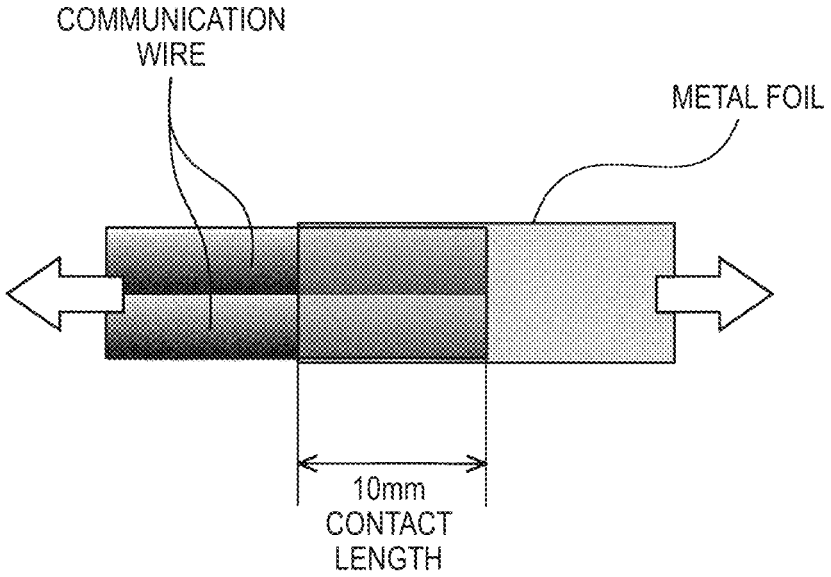
FIG. 5 is a conceptual diagram of an adhesion strength test.

Adhesion strength tests for measuring the adhesion strength of the communication cables of Examples 1 to 6 and Comparative Examples 1 to 4 were performed. FIG. 5 is a conceptual diagram of the adhesion strength test. As shown in FIG. 5, in the adhesion strength test, a contact length between the two-core communication wire and the metal foil was set to 10 mm, only the two-core communication wire and the metal foil at both ends were respectively grasped and pulled at a speed of 50 mm/min by a tensile tester, and the force until the two-core communication wire and the metal foil were separated was measured.

Figure 6:
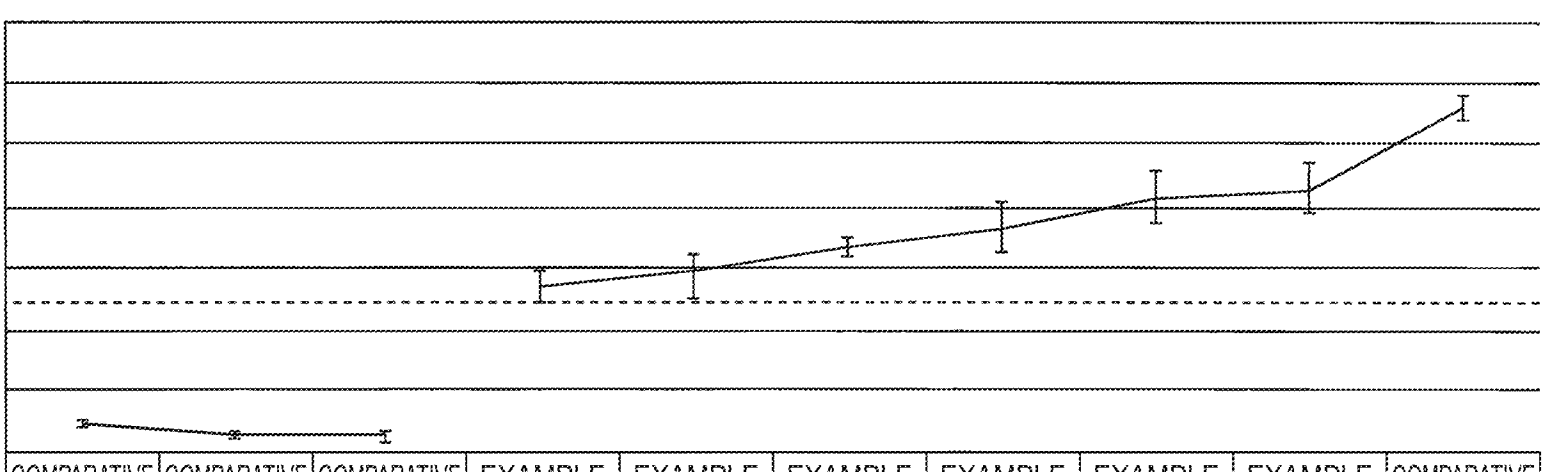
FIG. 6 is a graph showing a test result of the adhesion strength test.

FIG. 6 is a graph showing a test result of the adhesion strength test. In Examples 1 to 6 and Comparative Example 4, the same two-core communication wire, the drain wire, the metal foil, and the restraint were used. A tin-plated annealed copper wire was used for the drain wire, an aluminum foil was used for the metal foil, and a PET film was used for the restraint. For Comparative Examples 1 to 3, a two-core communication wire and a metal foil were used, and an aluminum foil was used as the metal foil. Here, in Comparative Example 4, the communication wire was an SPP wire, and this two-core communication wire was obtained together with the metal foil. The communication cables of Examples 1 to 6 were obtained by twisting the SPP wires according to Comparative Example 4.

First, Comparative Examples 1 to 3 are so-called STP wires, and the twist pitches of the two-core communication wires are different. The twist pitch was 24 mm in Comparative Example 1, 20 mm in Comparative Example 2, and 21 mm in Comparative Example 3.

In Examples 1 to 6, the twist pitches of the two-core communication wires are different, and the twist pitch was 15 mm in Example 1, 20 mm in Example 2, and 40 mm in Example 3. In addition, the twist pitch was 60 mm in Example 4.80 mm in Example 5, and 100 mm in Example 6.

As a result of conducting the above adhesion strength test of Examples 1 to 6 and Comparative Examples 1 to 4, the following results were obtained.

First, in Example 1, the adhesion strength was 1.35 MPa at an average value, was 1.48 MPa at the maximum value, and was 1.21 MPa at the minimum value. In Example 2, the adhesion strength was 1.48 MPa at the average value, was 1.61 MPa at the maximum value, and was 1.25 MPa at the minimum value. In Example 3, the adhesion strength was 1.66 MPa at the average value, was 1.74 MPa at the maximum value, and was 1.60 MPa at the minimum value.

In Example 4, the adhesion strength was 1.81 MPa at the average value, was 2.02 MPa at the maximum value, and was 1.63 MPa at the minimum value. In Example 5, the adhesion strength was 2.08 MPa at the average value, was 2.29 MPa at the maximum value, and was 1.88 MPa at the minimum value. In Example 6, the adhesion strength was 2.14 MPa at the average value, was 2.36 MPa at the maximum value, and was 1.97 MPa at the minimum value.

On the other hand, in Comparative Example 1, the adhesion strength was 0.23 MPa at the average value, was 0.26 MPa at the maximum value, and was 0.20 MPa at the minimum value. In Comparative Example 2, the adhesion strength was 0.13 MPa at the average value, was 0.16 MPa at the maximum value, and was 0.11 MPa at the minimum value. In Comparative Example 3, the adhesion strength was 0.13 MPa at the average value, was 0.16 MPa at the maximum value, and was 0.08 MPa at the minimum value.

In Comparative Example 4, the adhesion strength was 2.80 MPa at the average value, was 2.90 MPa at the maximum value, and was 2.71 MPa at the minimum value.

Figure 7:
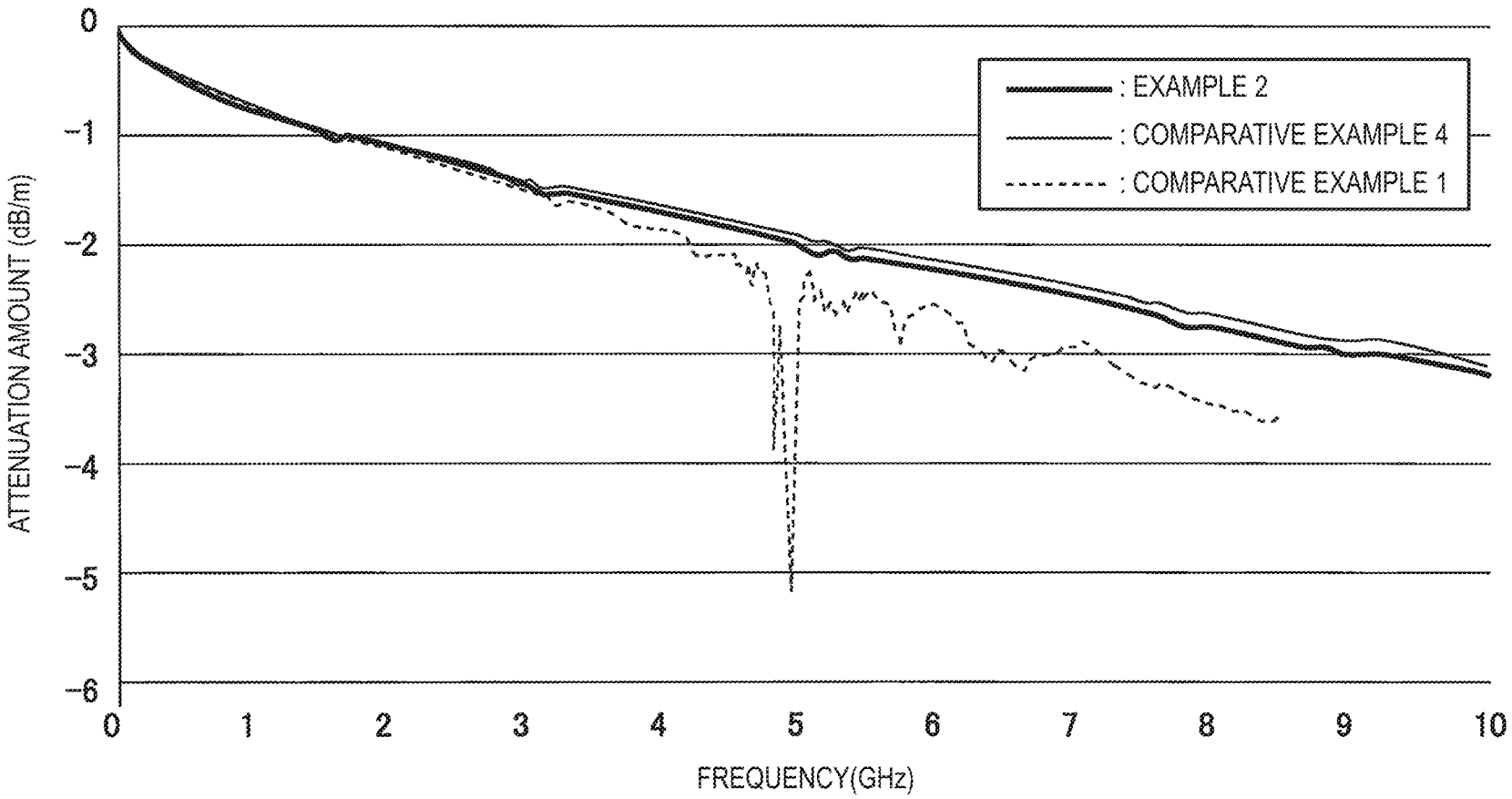
FIG. 7 is a graph showing attenuation amounts of communication cables according to Example 2, Comparative Example 1, and Comparative Example 4.

FIG. 7 is a graph showing attenuation amounts of communication cables according to Example 2, Comparative Example 1, and Comparative Example 4. In Comparative Example 1, since the adhesion strength is small, the distance between the conductor of the communication wire and the metal foil is likely to be uneven, and an increase in the attenuation amount due to suck-out is large. On the other hand, it was found that the communication cable according to Example 2 had the same attenuation characteristic as that of the SPP wire according to Comparative Example 4, and an influence of suck-out was small.

Although not shown, in Comparative Examples 2 and 3, the increase in the attenuation amount due to the suck-out was as larger as in Comparative Example 1, and in Example 1 and Examples 3 to 6, the influence of suck-out was smaller than those in Comparative Examples 1 to 3.

(Bending Test)

For the communication cables of Examples 1 to 6 and Comparative Example 4, a bending test for measuring the bendability of the drain wire was performed. In the bending test, a mandrel having a diameter of 25 mm was prepared, one end side of the communication cable having a predetermined length was unloaded, and the other end side thereof was repeatedly subjected to one-sided bending by 90° along the mandrel at a bending speed of 30 rpm. As a result of repeated bending, the number of reciprocal bending times until the drain wire was broken (a resistance value was increased by 10%) was measured. The measurement was performed five times. The maximum and minimum values were extracted and an average value was calculated. In addition, in Comparative Example 4, bending was performed in a short axis direction orthogonal to a long axis direction, and the drain wire was bent outward.

Figure 8:
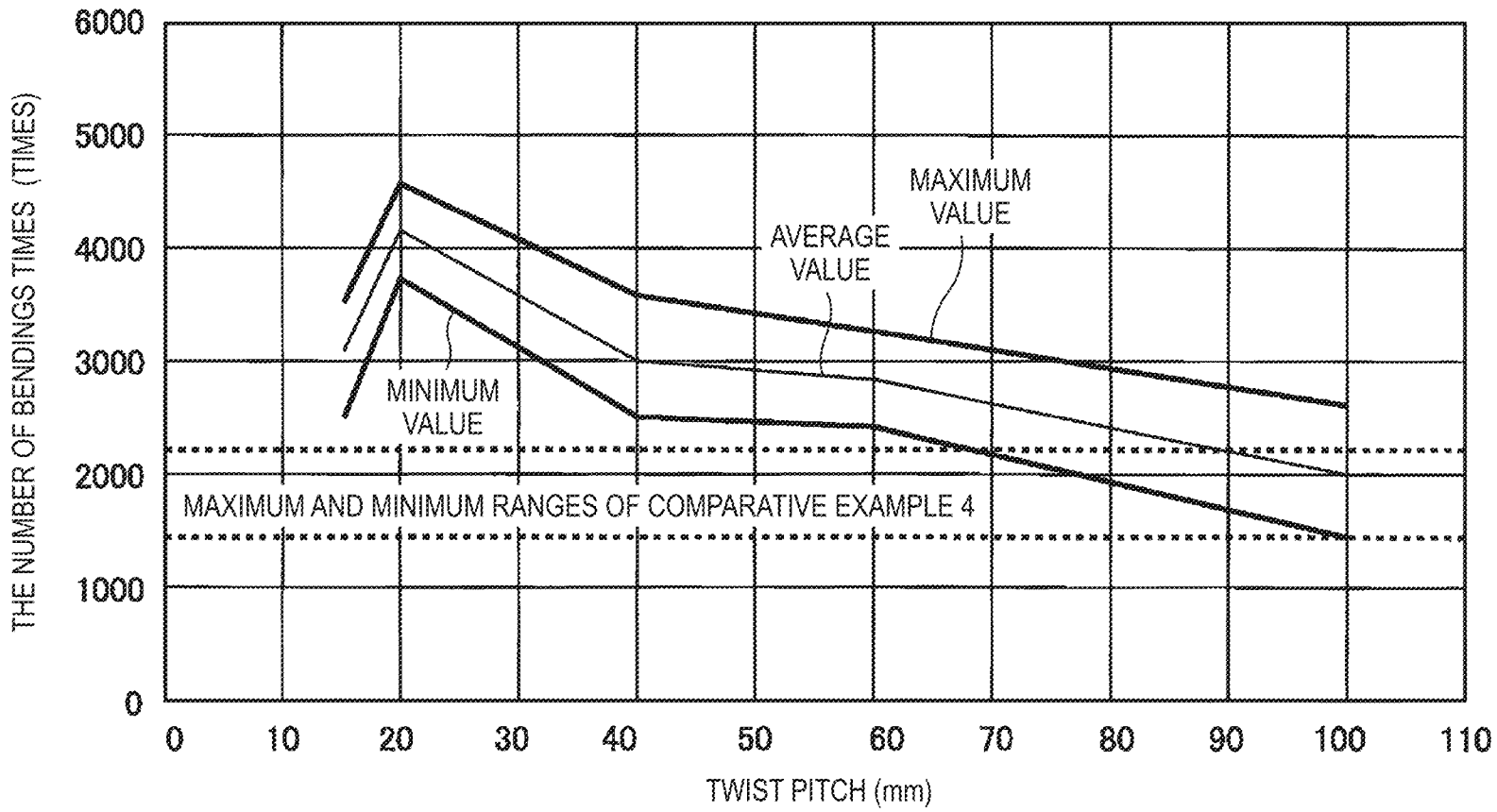
FIG. 8 is a graph showing the number of bending times (the number of breakage times) of drain wires of the communication cables according to Examples 1 to 6 and Comparative Example 4.

FIG. 8 is a graph showing the number of bending times (the number of breakage times) of drain wires of the communication cables according to Examples 1 to 6 and Comparative Example 4.

First, in Example 1, the number of bending times was more than 3000 times at the average value, was about 3500 times at the maximum value, and was about 2500 times at the minimum value. In Example 2, the number of bending times was about 4200 times at the average value, was about 4600 times at the maximum value, and was about 3800 times at the minimum value. In Example 3, the number of bending times was about 3000 times at the average value, was about 3500 times at the maximum value, and about 2500 times at the minimum value.

In Example 4, the number of bending times was about 2800 times at the average value, was about 3300 times at the maximum value, and about 2400 times at the minimum value. In Example 5, the number of bending times was about 2400 times at the average value, was about 2900 times at the maximum value, and about 1900 times at the minimum value. In Example 6, the number of bending times was about 2000 times at the average value, was about 2600 times at the maximum value, and about 1400 times at the minimum value.

On the other hand, in Comparative Example 4, the number of bending times in the short axis direction was about 2200 times at the maximum value, and was about 140 times at the minimum value.

From the above, it was found that the minimum value in a case where the twist pitch of the two-core communication wire was 15 mm or more and 60 mm or less exceeded the maximum value of the number of bending times in the short axis direction with respect to Comparative Example 4 (SPP wire). Therefore, it was found that if the twist pitch of the two-core communication wire is 15 mm or more and 60 mm or less, the communication cable exhibited a higher bendability than the SPP wire (short axis direction).

(Communication Characteristics)

The communication characteristics of the communication cables of Examples 1 to 4 and Comparative Example 4 were measured by measuring an S-parameter in an operation mode using a network analyzer.

Figure 9:
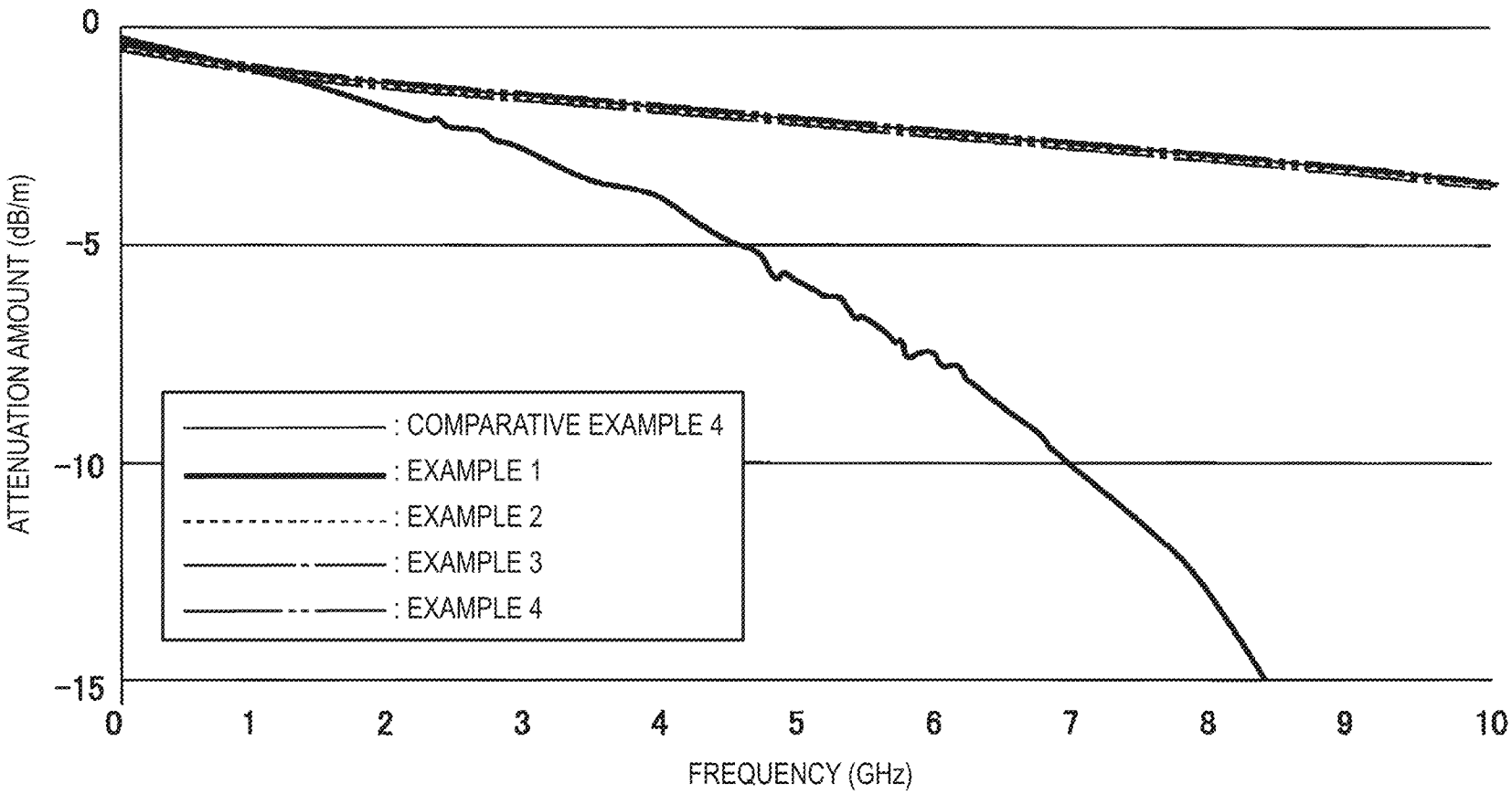
FIG. 9 is a graph showing attenuation characteristics related to the communication cables of Examples 1 to 4 and Comparative Example 4.

FIG. 9 is a graph showing attenuation characteristics related to the communication cables of Examples 1 to 4 and Comparative Example 4. As shown in Comparative Example 4, the good attenuation characteristics were obtained for the SPP wire, and the same attenuation characteristics were also obtained for the communication cables according to Examples 2 to 4. However, in the communication cable according to Example 1, since the twist pitch is 15 mm, the cable is damaged by an excessive load, and the attenuation characteristics are extremely deteriorated.

Therefore, for the communication cable, it has been found that it is preferable from a viewpoint of the attenuation characteristics that the twist pitch of the two-core communication wire is 20 mm or more.

Therefore, it can be said that the twist pitch of the two-core communication wire is preferably 20 mm or more and 60 mm or less.

As described above, according to the communication cable 1 according to the present embodiment, since the two-core communication wires 10 are twisted, it is not difficult to bend the wire in the specific direction, and the flexibility can be improved as compared with the SPP wire. In addition, since the metal foil 30 is wound around the two-core communication wires 10 with the adhesion strength of 1.21 MPa or more, the adhesion strength between the two-core communication wires 10 and the metal foil 30 is improved, so that suck-out is suppressed as compared with the STP wire. Therefore, it is possible to provide the communication cable 1 capable of improving the flexibility while suppressing suck-out.

In addition, since the two-core communication wires 10 are twisted with the twist pitch of 20 mm or more, it is possible to prevent the communication wire 10 from being damaged and the attenuation characteristics from being significantly deteriorated due to the too strong twist and an excessive load from being applied to the communication wire 10. In addition, since the two-core communication wires 10 are twisted with the twist pitch of 60 mm or less, it is possible to obtain a higher bending resistance than the short axis direction of the non-twisted SPP wire.

In addition, since the restraint 40 formed of a resin coating extruded around the metal foil 30 or a resin film laterally wound around the metal foil is further provided, it is easy to maintain the adhesion strength of the metal foil 30 to the two communication wires 10, and deterioration of communication characteristics in long-term use can be suppressed.

Further, according to the wire harness WH according to the present embodiment, it is possible to provide the wire harness WH including the communication cable 1 capable of improving the flexibility while suppressing suck-out.

The present invention has been described based on the embodiment, but the present invention is not limited to the embodiment described above and can be appropriately modified without departing from the spirit of the present invention, and may be appropriately combined with well-known and known techniques if possible.

For example, it has been described that the twist pitch of the two-core communication wire 10 is preferably 20 mm or more and 60 mm or less in the present embodiment, but the twist pitch may be 15 mm, 80 mm, 100 mm, or the like in view of flexibility and suppression of suck-out.

What is claimed is:

1. A communication cable comprising:
two-core communication wires;
a drain wire; and
a metal foil collectively covering the two-core communication wires and the drain wire,
wherein the two-core communication wires are twisted, and
wherein the metal foil winds around the two-core communication wires and is a winding structure that adheres to the two-core communication wires with an adhesion strength of 1.21 MPa or more.

2. The communication cable according to claim 1,
wherein the two-core communication wires are twisted with a twist pitch of 20 mm or more and 60 mm or less.

3. A wire harness comprising:
the communication cable according to claim 2.

4. The communication cable according to claim 1, further comprising:
a restraint formed of a resin coating extruded around the metal foil or a resin film laterally that winds around the metal foil.

5. A wire harness comprising:
the communication cable according to claim 1.

6. A communication cable comprising:
two-core communication wires;
a drain wire; and
a metal foil collectively covering the two-core communication wires and the drain wire,
wherein the two-core communication wires are twisted,
wherein the metal foil winds around the two-core communication wires and is a winding structure that adheres to the two-core communication wires with a separating force of 1.21 MPa or more,
wherein the separating force is a force until the two-core communication wire and the metal foil were separated in a state that a contact length between the two-core communication wire and the metal foil was set to 10 mm, only the two-core communication wire and the metal foil at both ends were respectively grasped and pulled at a speed of 50 mm/min by a tensile tester.

7. The communication cable according to claim 1,
wherein the two-core communication wires are twisted with a twist pitch of 60 mm or more and 100 mm or less, and
the metal foil winds around the two-core communication wires and adheres to the two-core communication wires with an adhesion strength of 1.63 MPa or more and 2.36 MPa or less.

* * * * *